US007170448B2

(12) United States Patent
Jecko et al.

(10) Patent No.: US 7,170,448 B2
(45) Date of Patent: Jan. 30, 2007

(54) OMNIDIRECTIONAL RESONANT ANTENNA

(75) Inventors: Bernard Jecko, Rilhac Rancon (FR); Francois Torres, Veyrac (FR); Guillaume Villemaud, Rillieux la Pape (FR)

(73) Assignee: Centre National de la Recherche Scientifique (C.N.R.S.), Paris (FR)

( * ) Notice: Subject to any disclaimer, the term of this patent is extended or adjusted under 35 U.S.C. 154(b) by 0 days.

(21) Appl. No.: 10/479,749

(22) PCT Filed: Jun. 6, 2002

(86) PCT No.: PCT/FR02/01935

§ 371 (c)(1),
(2), (4) Date: May 7, 2004

(87) PCT Pub. No.: WO02/101877

PCT Pub. Date: Dec. 19, 2002

(65) Prior Publication Data

US 2004/0183730 A1 Sep. 23, 2004

(30) Foreign Application Priority Data

Jun. 8, 2001 (FR) ..... 01 07546

(51) Int. Cl.
*H01Q 1/38* (2006.01)
*H01Q 21/26* (2006.01)
*H01Q 9/26* (2006.01)

(52) U.S. Cl. ..... 343/700 MS; 343/797; 343/803

(58) Field of Classification Search ..... 343/702, 343/722, 797, 803, 700 MS, 725
See application file for complete search history.

(56) References Cited

U.S. PATENT DOCUMENTS 5,363,114 A * 11/1994 Shoemaker ..... 343/828
5,986,606 A * 11/1999 Kossiavas et al. ... 343/700 MS
6,008,762 A * 12/1999 Nghiem ..... 343/700 MS
6,046,700 A 4/2000 Kitchener et al. ..... 343/725
6,107,967 A * 8/2000 Hill ..... 343/702

(Continued)

FOREIGN PATENT DOCUMENTS

EP 0 444 679 9/1991

(Continued)

*Primary Examiner*—Don Wong
*Assistant Examiner*—Marie Antoinette Cabucos
(74) *Attorney, Agent, or Firm*—Young & Thompson

(57) ABSTRACT

An omnidirectional resonant antenna in a half-plane or in the whole plane comprises a single radiating electric conductor (26) having at least three abutted wires (28, 30, 32), the length of each wire and the orientation of the wires relative to one another determining the global orientation of the electric conductor. The wires are oriented along at least three different spatial directions and the lengths of the wires are designed to obtain an omnidirectional global radiation of the electric conductor in a half-plane or in the whole plane.

19 Claims, 3 Drawing Sheets

U.S. PATENT DOCUMENTS

| | | | | |
|---|---|---|---|---|
| 6,114,996 | A * | 9/2000 | Nghiem | 343/700 MS |
| 6,184,833 | B1 * | 2/2001 | Tran | 343/700 MS |
| 6,222,494 | B1 * | 4/2001 | Erkocevic | 343/790 |
| 6,239,753 | B1 * | 5/2001 | Kado et al. | 343/702 |
| 6,259,407 | B1 * | 7/2001 | Tran | 343/700 MS |
| 6,300,908 | B1 * | 10/2001 | Jecko et al. | 343/700 MS |
| 6,573,867 | B1 * | 6/2003 | Desclos et al. | 343/700 MS |
| 6,650,294 | B2 * | 11/2003 | Ying et al. | 343/700 MS |
| 2001/0007445 | A1 * | 7/2001 | Pankinaho | 343/844 |
| 2001/0054979 | A1 | 12/2001 | Bahr et al. | 343/700 MS |

FOREIGN PATENT DOCUMENTS

| | | |
|---|---|---|
| EP | 0 590 671 | 4/1994 |
| EP | 0 793 293 | 9/1997 |
| GB | 2 349 983 | 11/2000 |
| WO | WO 01/06596 | 1/2001 |

* cited by examiner

OMNIDIRECTIONAL RESONANT ANTENNA

BACKGROUND OF THE INVENTION

The present invention relates to omnidirectional resonant antennas and more particularly to omnidirectional resonant antennas operating in a half-space or all of space.

DESCRIPTION OF THE RELATED ART

It is known in the prior art to produce resonant antennas, that is to say antennas of which the dimensions have been determined in such a manner that they have a resonance phenomenon for multiples of a predetermined frequency. These antennas use the resonance phenomenon in order to increase the energy of the radiation emitted and/or received at the predetermined frequency and thus have a limited pass band. These antennas also have the advantage that they are compact by comparison with non-resonant antennas, that is to say antennas which do not have a resonance phenomenon for multiples of a predetermined frequency.

These antennas can be produced with the aid of a single electric conductor forming a dipole or a monopole, usually of the strand type. They are for example produced with the aid of a metal cover imprinted on a dielectric substrate, these latter antennas being known by the name of "patch antennas". Another mode of production consists of cutting out slots in a mass plane, these antennas being known by the name of "slot antennas". However, at best, it is known nowadays to produce omnidirectional resonant antennas operating in a spatial plane, that is to say that the electromagnetic radiation emitted or received is substantially uniform irrespective of the direction of this plane.

Systems also exist in the prior art which comprise three resonant antennas each oriented in a different spatial direction. These antennas are connected to the input of a signal processing computer. The computer is adapted to process the signals received at the input in such a way as to restore at the output one single signal similar to that of an omnidirectional resonant antenna operating in all spatial directions.

However, these systems are difficult to integrate into industrial applications, particularly because of the presence of the computer.

Therefore no resonant antennas exist at present which have the simplicity of the antennas formed with one single electrical conductor whilst being omidirectional in a half-space or all of space.

SUMMARY OF THE INVENTION

Therefore the object of the present invention is to fill this gap by creating an omnidirectional resonant antenna operating in a half-space or in all of space.

It therefore relates to an omnidirectional resonant antenna operating in a half-space or all of space having one single radiating electric conductor formed of at least three strands placed end to end, the length of each strand and the orientation of the strands with respect to one another contributing to determining the global radiation of the electric conductor, characterised in that the strands are oriented in at least three different spatial directions and that the lengths of the strands are determined in such a manner as to obtain an omnidirectional global radiation of the electric conductor operating in a half-space or in all of space.

According to other characteristics of the invention, it may also comprise one or several of the following characteristics:

- the radiating electric conductor has two parts which are symmetrical with respect to a plane of symmetry in order to obtain radiation of the electric conductor which is omnidirectional in all of space;
- the radiating electric conductor is composed of a first, a second, a third, a fourth and a fifth strand, the fourth and fifth strands being respectively the images by symmetry of the second and the first strands with respect to the median plane of symmetry of the third strand;
- a strand at the end of the radiating electric conductor is positioned perpendicular to a mass plane;
- the dimensions of the mass plane are less than the wavelength $\lambda$ in order to obtain omnidirectional radiation of the electric conductor in all of space;
- the dimensions of the mass plane are several times greater than the wavelength $\lambda$ in order to obtain omnidirectional radiation of the electric conductor operating in a half-space;
- it has mass elements and in that the strands of the radiating electric conductor are respectively coplanar therewith;
- the radiating electric conductor has a first end connected to a wave emitter/receiver and a second end connected to the mass plane;
- the radiating electric conductor has a first end connected to a wave emitter/receiver and a second end connected to the mass elements;
- the radiating electric conductor is connected to the wave emitter/receiver by means of an electromagnetic coupling zone;
- the dimensions of the electromagnetic coupling zone partially determine the real impedance of the antenna;
- the radiating electric conductor is composed of a first, a second and a third strand;
- the consecutive strands of the radiating electric conductor are oriented in two directions which are orthogonal with respect to one another;
- the strands are each formed by a band of which the width is determined in such a manner as to adapt, at least partially, the real impedance of the antenna to the impedance of a wave emitter/receiver intended to be connected to the antenna;
- the radiating electric conductor is composed of wire strands;
- the radiating electric conductor has a first end connected to a wave emitter/receiver and a second free end;
- the radiating electric conductor is associated with a dielectric material reducing the dimensions of the antenna;
- the radiating electric conductor is embedded in a dielectric material reducing the dimensions of the antenna; and
- the radiating electric conductor is positioned on the surface of a dielectric material reducing the dimensions of the antenna.

The invention also relates to a device for receiving and emitting electromagnetic radiation in a half-space or in all of space, characterised in that it has a plurality of omnidirectional resonant antennas as claimed in any one of the preceding claims.

BRIEF DESCRIPTION OF THE DRAWINGS

The invention will be better understood upon reading the following description which is given solely by way of example and with reference to the accompanying drawings, in which.

DESCRIPTION OF THE PREFERRED EMBODIMENT

Figure 1:
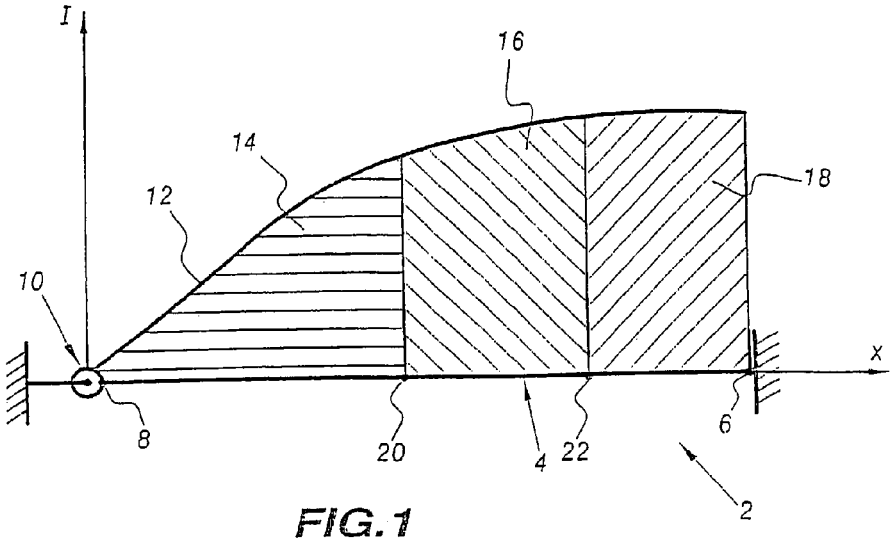
FIG. 1 shows schematically an electric conductor connected by a first end to a wave emitter/receiver and by a second end to a mass, as well as a graph illustrating the distribution of the surface current density along this conductor.

FIG. 1 shows an electric conductor 4 forming a monopole extending along the axis of the co-ordinates of the graph. In a conventional manner this is a "quarter-wave" electric conductor, that is to say an electric conductor of which the total length is equal to quarter of a wavelength, denoted by λ, of a predetermined frequency. The predetermined frequency is hereafter called the "working frequency". A constructive resonance phenomenon is produced in the electric conductor 4 when electromagnetic radiation of which the wavelength is λ is emitted and/or received. The electric conductor 4 is formed here by a current-conducting band of constant width. The electric conductor 4 has a first end 6 connected to a mass and a second end 8 connected to a wave emitter/receiver 10 such as a conventional microwave emitter/receiver. In the following description the term "wave emitter/receiver" is used to mean an emitter/receiver capable of emitting and/or receiving electromagnetic radiation at a given frequency which is connected to an electric conductor. A curve 12 represents the distribution of the surface current density along the electric conductor at the working frequency. This curve is determined for example with the aid of conventional software for simulation of electromagnetic radiation of electric conductors. The area between the curve 12 and the electric conductor 4 is divided into three areas 14, 16 and 18 of equal surface area and of which the interesting features will become apparent later in the description. A point 20 on the electric conductor 4 marks the limit separating the area 14 from the area 16; equally a point 22 on the electric conductor 4 marks the limit separating the area 16 from the area 18. Thus the points delimit two strands placed end to end on the electric conductor 4.

The areas 14, 16 and 18 are respectively proportional at the level of radiation of the strands of the electric conductor 4 between the end 8 and the point 20, between the points 20 and 22 and between the point 22 and the end 6. It will be appreciated therefore that with the aid of FIG. 1 it is possible to determine the length of an electric conductor so that it has a predetermined level of radiation.

Figure 2:
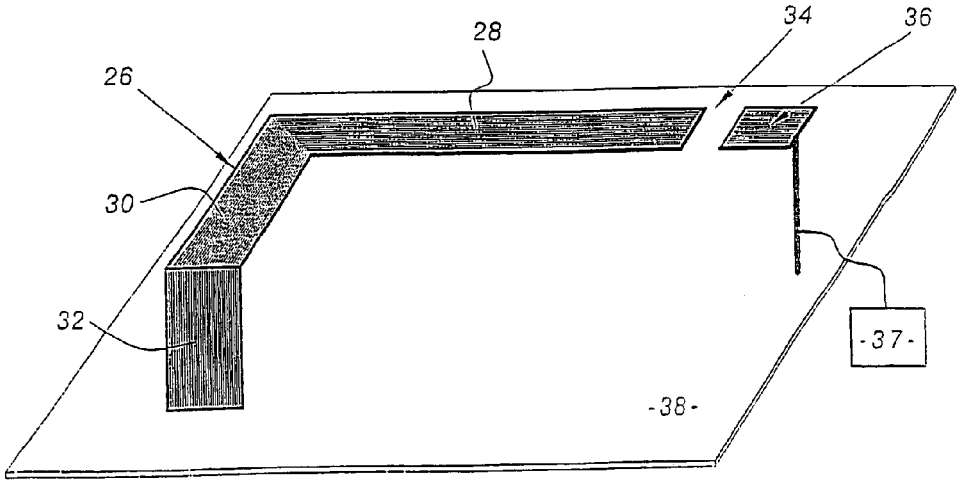
FIG. 2 shows schematically in perspective a first embodiment of an omnidirectional resonant antenna operating in space according to the invention, dimensioned on the basis of the graph of FIG. 1.

FIG. 2 shows a first embodiment of an omnidirectional resonant antenna on the basis of the graph of FIG. 1. This includes an electric conductor forming a monopole similar to that of FIG. 1. Thus the electric conductor 26 has a distribution of surface current density and per unit of length which is similar to that of FIG. 1. It is composed of three strands 28, 30 and 32 which are placed end to end and are orthogonal with respect to one another. The strand 28 has a length equal to that of the strand between the end 8 and the point 20 of FIG. 1. The strand 30 has a length equal to that of the strand between the points 20 and 22 of FIG. 1. The strand 32 has a length equal to that of the strand between the point 22 and the end 6 of FIG. 1. The free end of the strand 28 is connected by means of an electromagnetic coupling zone 34 to a terminal 36 of a wave emitter/receiver 37. The length of the coupling zone 34, that is to say the space between the free end of the strand 28 and the terminal 36, is determined by simulation or experimentally in order to adapt the real impedance of the antenna to the impedance of the wave emitter/receiver 37. It will be noted that it is equally possible to act on the width of each strand of the electric conductor 26 in order to adapt the real impedance of the antenna to the impedance of the wave emitter/receiver 37 in such a way as to limit the reflection phenomena at the interface of these two devices 26 and 37. The free end of the strand 32 is connected perpendicularly to a mass plane 38 of which the dimensions are less than the wavelength λ of the working frequency. In these conditions the mass plane 38 does not form a screen to the radiation of the electric conductor 26. On the other hand, the different parameters of the strands (length, width, orientation, . . . ) must be adjusted in order to compensate for the effects of the edge of the mass plane 38.

As a variant, the mass plane 38 is a plane of which the width and the length are several times greater than the wavelength λ of the working frequency of the electric conductor 26. Then it is said that the mass plane is infinite. It will be noted that an infinite mass plane forms a screen to the electromagnetic radiation of an electric conductor such as the conductor 26 and that consequently the resonant antenna is omnidirectional in a half-space. In this case the lengths of the strands such as the strands 28, 30 and 32 are respectively less than $$\frac{\lambda}{5}, \frac{\lambda}{10}, \text{and } \frac{\lambda}{80},$$

where λ is the wavelength of the working frequency.

Thus for example for a wavelength λ=314 mm and for an electric conductor formed with a band of 5 mm width, the lengths of each of the strands corresponding to the strands 28, 30 and 32 are respectively 53 mm, 30 mm and 3 mm. Furthermore, in this example the width of the coupling zone such as the zone 34 is 1 mm, the terminal 36 has a length of 4 mm and the diameter of the wire for connection to the emitter/receiver is 0.2 mm.

Figure 3:
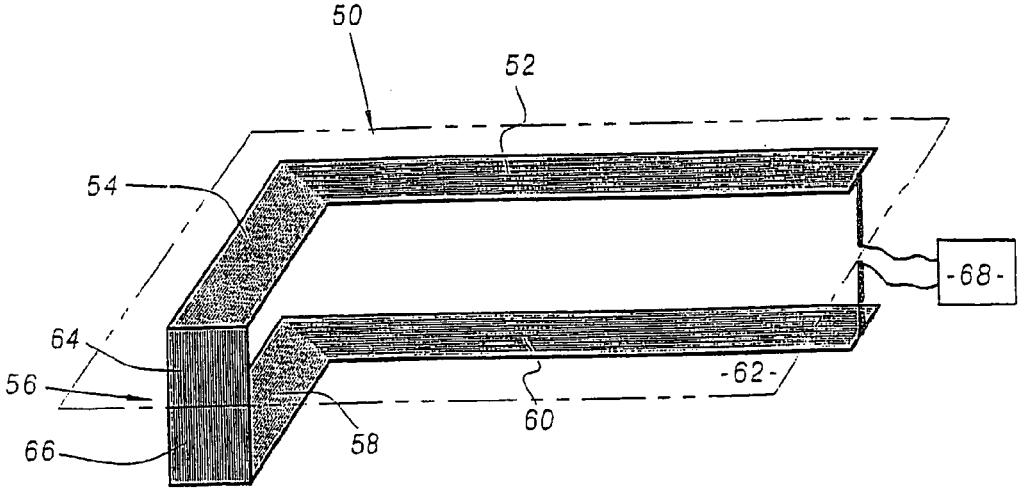
FIG. 3 shows in perspective a second embodiment of an omnidirectional resonant antenna operating in space according to the invention.

FIG. 3 shows a second embodiment of an omnidirectional resonant antenna operating in space according to the invention in which the resonant antenna is formed by an electric conductor 50 forming a monopole. This electric conductor has five strands 52, 54, 56, 58 and 60 which are placed end to end and are disposed in such a way as to form a first and a second part which are the image of one another with respect to a plane of symmetry 62. The strands 52, 54 and 56 are rectilinear and orthogonal in pairs with respect to one another. The first part is composed of the strands 52 and 54 and a half-strand 64. The half-strand 64 represents the upper half of the strand 56. The strands 52, 54 and 64 form an electric conductor similar to the electric conductor 26 described with regard to FIG. 2. The total length of the electric conductor formed by the strands 52, 54 and by the half-strand 64 is equal to the wavelength of the working frequency divided by four. More precisely, the length of the strand 52 is equal to that of the strand between the end 8 and the point 20 of FIG. 1. The length of the strand 54 is equal to that of the strand between the points 20 and 22 of FIG. 1. The length of the half-strand 64 is equal to that of the strand between the point 22 and the end 6 of FIG. 1. The second part of the electric conductor 50 is composed of the strands 58, 60 and a half-strand 66. The half-strand 66 represents the lower half of the strand 56. The dimensions of the strands 58, 60 and of the half-strand 66 are respectively the same as those of the strands 54, 52 and the half-strand 64. The second part of the electric conductor 50 is intended to produce an electric image of the first part in such a way as to simulate the existence of a mass plane. Thus the second part fulfils the functions of a mass plane such as the mass plane 38 of FIG. 2 for the first part, and vice versa. This is why the dimensions of the strands of the first part are determined in the same way as in the embodiment according to FIG. 2. The free end of the strand 52 is connected to a first terminal of a wave emitter/receiver 68 and the free end of the strand 60 is connected to a second terminal of the wave emitter/receiver 68. This first and this second terminal are equally the image of one another with respect to the plane of symmetry 62 in such a way that a phase displacement is not introduced between the signals transmitted/received by the wave emitter/receiver 68.

Figure 4:
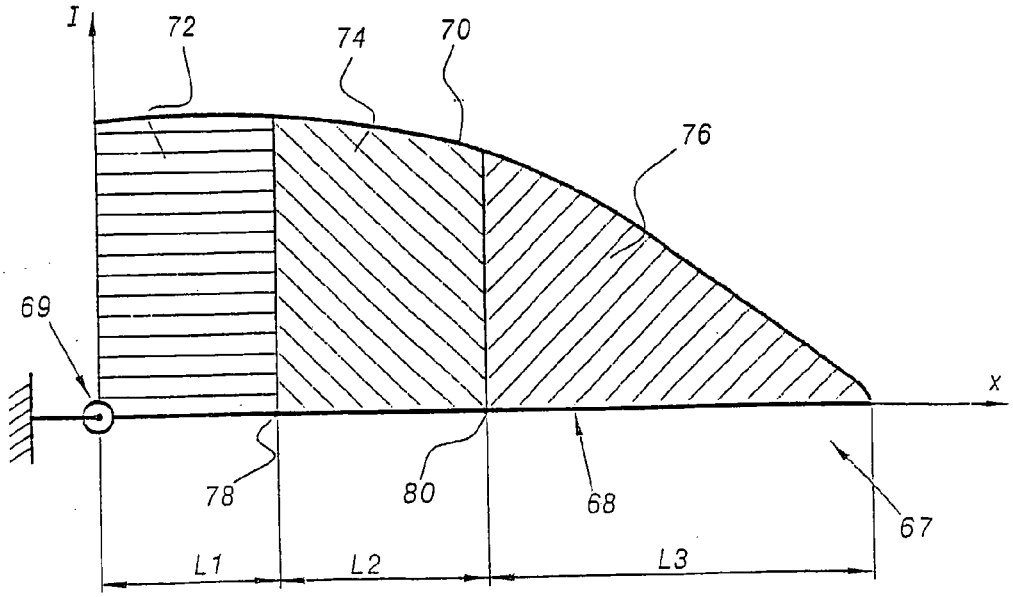
FIG. 4 shows an electric conductor connected by a first end to a wave emitter/receiver, the second end thereof being free, as well as a graph illustrating the distribution of the surface current density along this conductor.

FIG. 4 shows an electric conductor 68 forming a monopole extending along the axis of the co-ordinates of the graph. This electric conductor is formed here by a current-conducting band of constant width, but other forms may be used in other embodiments. A first end of this electric conductor is connected to a wave emitter/receiver 69. The second end remains free. A curve 70 represents the surface current density along the electric conductor 68 at the working frequency. This curve is obtained for example with the aid of conventional simulation software. In this example, and in a similar manner to that described with regard to FIG. 1, the area between the curve 12 and the electric conductor 68 is divided into three areas 72, 74 and 76 of equal surface area. Once these areas are defined, a point 78 is placed on the electric conductor 68 to mark the limit between the area 72 and the area 74. Equally a point 80 on the electric conductor 68 marks the limit between the area 74 and the area 76. The points 78 and 80 cut the electric conductor 68 into three strands of respective lengths L1, L2 and L3. The surfaces of the areas 72, 74 and 76 are respectively proportional to the levels of radiation of the strands of length L1, L2 and L3.

Figure 5:
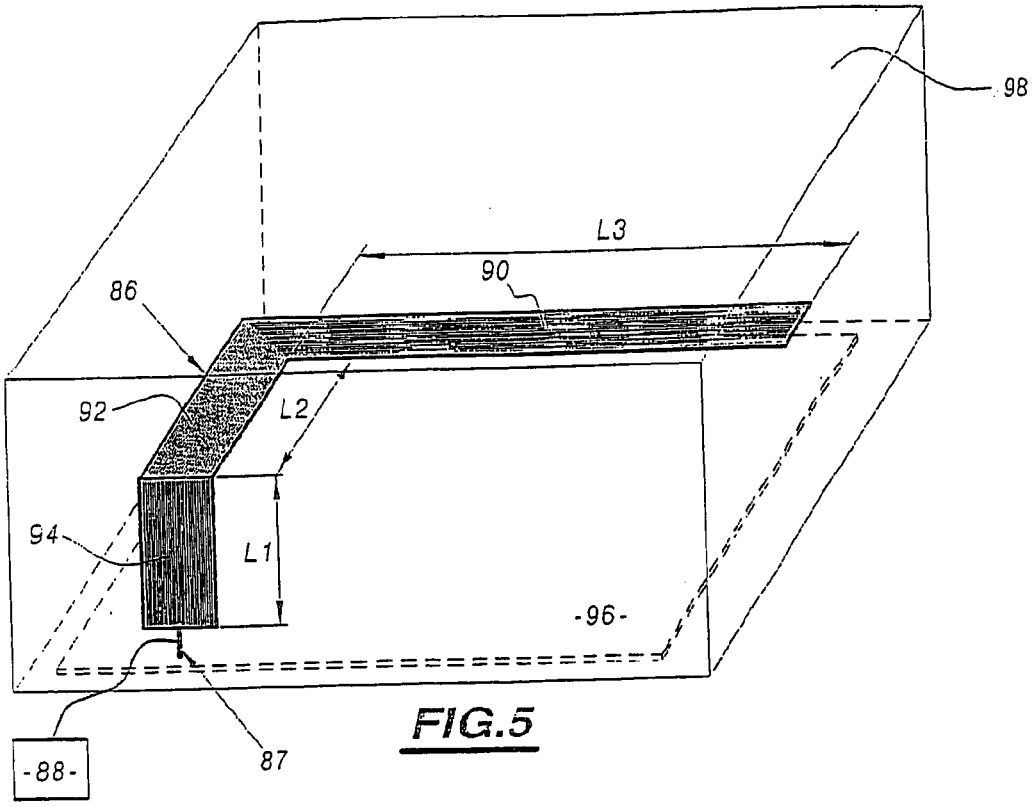
FIG. 5 shows in perspective a third embodiment of an omnidirectional resonant antenna operating in space according to the invention, dimensioned on the basis of the graph of FIG. 4.

FIG. 5 shows a resonant antenna dimensioned according to the graph of FIG. 4. This antenna has an electric conductor 86 forming a monopole similar to the electric conductor 68 of FIG. 4. The electric conductor 86 is connected by a first end to a terminal 87 of a wave emitter/receiver 88. A second end of the electric conductor 68 remains free. This electric conductor 86 is composed of three strands 90, 92 and 94 placed end to end. These strands are rectilinear and orthogonal in pairs with respect to one another. The length of each of these strands is determined in accordance with FIG. 4, that is to say that the strand 94 has a length L1, the strand 92 has a length L2 and the strand 90 has a length L3. The free end of the strand 94 is connected to the wave emitter/receiver 88 whilst being perpendicular to a mass plane 96 of which the dimensions are less than the wavelength λ of the working frequency. The whole of the antenna constituted by the electric conductor 86 and the mass plane 96 is embedded in a dielectric material 98 in order to reduce the dimensions of the antenna. In effect, embedding the electric conductor of an antenna in a dielectric material or disposing it on the surface of a dielectric material makes it possible to reduce the dimensions required for the electric conductor and therefore for the antenna.

Figure 6:
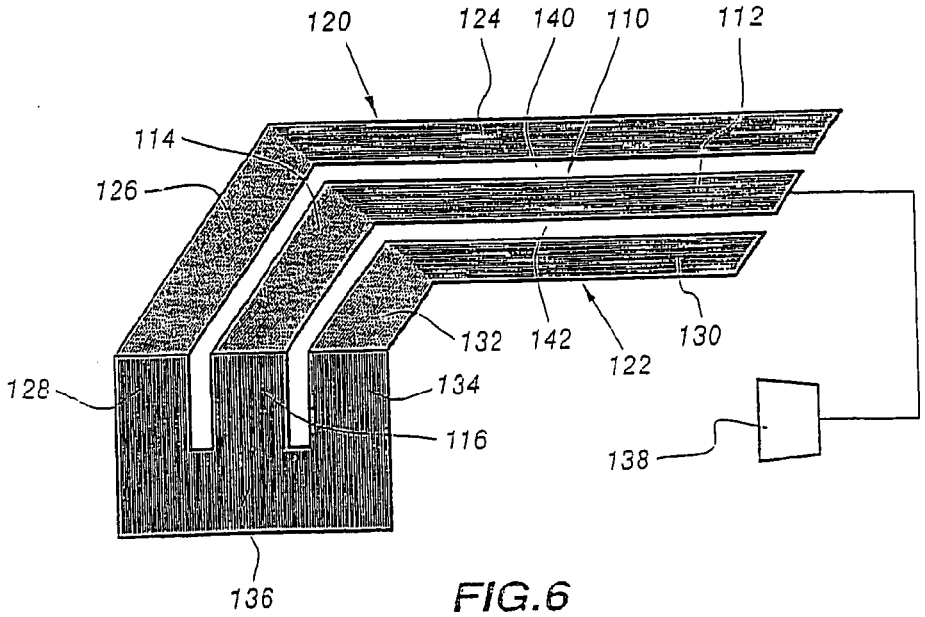
FIG. 6 shows in perspective a fourth embodiment of an omnidirectional resonant antenna operating in space according to the invention.

The resonant antenna of FIG. 6 has an electric conductor 110 formed by a band of current-conducting material of constant width. This electric conductor is composed of three strands 112, 114 and 116 which are placed end to end and are orthogonal in pairs with respect to one another. The antenna also has two mass elements 120 and 122. These mass elements 120 and 122 are each formed by a band of current-conducting material of constant width. The first element 120 has three strands 124, 126 and 128 placed end to end. The second mass element 122 also has three strands 130, 132 and 134 placed end to end. These two mass elements 120 and 122 are respectively disposed to the right and to the left of the electric conductor 110. The strands 124 and 130 of the mass elements are parallel to and coplanar with the strand 112 of the electric conductor 110. Equally, the strands 126 and 132 and the strands 128 and 134 are respectively parallel to and coplanar with the strands 114 and 116 of the electric conductor 110. The ends of the strands 128, 116 and 134 opposite the strands 126, 114 and 132 are connected to one another by a current-conducting element 136. The free end of the strand 112 is connected to a wave emitter/receiver 138. The lengths of the strands 112, 114 and 116 are determined as a function of the distribution of the surface current density along the electric conductor 110 in a similar manner to that described with regard to FIGS. 1 and 2. The width of the gaps 140, 142 separating the strands of the mass elements from the strands of the electric conductor 110, that is to say the width of the bands forming the mass elements, are determined by simulation or by experimentation in order to adapt the real impedance of the antenna to that of the wave emitter/receiver 138. Such an antenna is typically produced by cutting slots of constant width in a metal sheet which is then bent at right angles.

The operation of the resonant antenna which is omnidirectional in space will now be described with the aid of FIGS. 1 and 2.

During the emission of electromagnetic radiation at the working frequency with the aid of the antenna of FIG. 2, the wave emitter/receiver 37 generates, by electromagnetic coupling in the electromagnetic coupling zone 34, a surface current density in the electric conductor 26. The surface current density thus created is distributed along the electric conductor 26 as illustrated on the graph of FIG. 1.

The length of the strands 28, 30 and 32 is determined so that the areas 14, 16 and 18 have an equal surface area. Consequently the levels of radiation of each of the strands of the electric conductor 26 are the same.

Moreover, the level of radiation emitted at any point in space is practically the vectorial sum of the radiation emitted by each of the strands 28, 30 and 32. These strands are orthogonal with respect to one another and as the radiation emitted by a strand is parallel to the direction thereof it will be appreciated that the radiation emitted by one strand does not interfere with that of the others. Thus it will be noted that the orthogonal strands optimise the gain of the antenna whilst avoiding destructive interference phenomena. Thus it will be appreciated that this antenna does not favour any particular direction in space, since the strands are orthogonal and the level of radiation of each strand is the same. Consequently, the antenna thus produced is practically omnidirectional. It is considered here that the radiation is practically omnidirectional in a predetermined region of space, if the level of radiation emitted/received by the antenna in any two directions of this region of space does not vary by more than 50%.

It will be noted that the mass plane 38 does not constitute a screen to the electromagnetic radiation and that consequently the radiation of the preceding antenna is omnidirectional in all of space.

During the reception of electromagnetic radiation at the working frequency with the aid of the antenna of FIG. 2, the levels of radiation received in the directions of the strands 28, 30 and 32 are respectively proportional to the areas 14, 16 and 18 and therefore determined by the respective lengths of each strand. In the particular case of the first embodiment, the length of each strand has been chosen so that the areas 14, 16 and 18 are equal. Consequently the level of radiation received for a given radiation parallel to a strand will be the same regardless of whether this radiation is parallel to the strands 28, 30 or 32. Radiation from any direction can always be broken down into three components respectively parallel to the tree strands 28, 30 and 32, and therefore the global level of radiation received by the antenna is unchanged irrespective of the direction of this radiation. It will be noted that, like the emission, the reception is not limited by the mass plane 38 to a half-space if the dimensions thereof in terms of width and length are less than λ.

The operation of the antenna shown in FIG. 3 follows from what has already been described.

In effect, the second part of the electric conductor 50 of the antenna formed by the strands 58, 60 and the half-strand 66 fulfils the functions of an mass plane extending along the plane of symmetry 62 for the first part formed by the strands 52, 54 and the half-strand 64. Consequently the study of the operation of the first part of the antenna leads to the study of the operation of an electric conductor connected perpendicularly to a mass plane merging with the plane of symmetry 62. The operation of such a structure has already been described with regard to FIG. 2.

Conversely, the first part of the antenna fulfils the functions of a mass plane merging with the plane of symmetry 62 for the second part of the antenna. Consequently, in a manner similar to that which has just been described above, the operation of the second part of the antenna leads to the study of an antenna of which the structure is similar to that described with regard to FIG. 2.

The operation of the resonant antennas shown respectively in FIGS. 5 and 6 may be deduced easily from the operation of the antenna described with regard to FIG. 2.

As a variant, the electric conductor of the preceding embodiments is composed of strands formed by wire elements instead of strands in the form of bands. The diameter of the wire forming each strand is determined so as to adjust the real impedance of such an antenna to that of the wave emitter/receiver.

As a variant, the electric conductor of the preceding embodiments is composed of strands of any form in respect of which it is possible to calculate the surface current density at the working frequency.

Advantageously a device for receiving and emitting electromagnetic radiation has a plurality of omnidirectional resonant antennas operating in a half-space or in all of space such as those described above, each adapted so as to receive and emit a predetermined wavelength. Thus the device for reception and emission is simultaneously omnidirectional in a half-space or in all of space, and capable of receiving and emitting at different wavelengths.

The invention claimed is:

1. Omnidirectional resonant antenna operating in a half-space or all of space, comprising:

one single radiating electric conductor formed of at least three strands placed end to end, the length of each strand and the orientation of the strands with respect to one another contributing to determining the global radiation of the electric conductor, wherein, the strands are oriented in at least three different spatial directions and the lengths of the strands are determined in such a manner as to obtain an omnidirectional global radiation of the electric conductor operating in a half-space or in all of space, and the omnidirectional global radiation in the half-space results in the level of radiation emitted by the conductor in any two directions of the half-space not varying by more than 50% and the omidirectional global radiation in all of space results in the level of radiation emitted by the conductor in any two directions of all space not varying by more than 50%.

2. Resonant antenna as claimed in claim 1, wherein the radiating electric conductor has two parts which are symmetrical with respect to a plane of symmetry in order to obtain radiation of the electric conductor which is omnidirectional in all of space.

3. Resonant antenna as claimed in claim 2, wherein the radiating electric conductor is composed of a first, a second, a third, a fourth and a fifth strand, the fourth and fifth strands being respectively the images by symmetry of the second and the first strands with respect to the median plane of symmetry of the third strand.

4. Antenna as claimed in claim 1, wherein a strand at the end of the radiating electric conductor is positioned perpendicular to a mass plane.

5. Resonant antenna with a wavelength λ as claimed in claim 4, wherein the dimensions of the mass plane are less than the wavelength λ in order to obtain an omnidirectional radiation of the electric conductor in all of space.

6. Resonant antenna with a wavelength λ as claimed in claim 4, wherein the dimensions of the mass plane are several times greater than the wavelength λ in order to obtain an omnidirectional radiation of the electric conductor operating in a half-space.

7. Resonant antenna as claimed in claim 1, wherein it has mass elements and in the strands of the radiating electric conductor are respectively coplanar therewith.

8. Resonant antenna as claimed in claim 4, wherein the radiating electric conductor has a first end connected to a wave emitter/receiver and a second end connected to the mass plane.

9. Resonant antenna as claimed in claim 7, wherein the radiating electric conductor has a first end connected to a wave emitter/receiver and a second end connected to mass elements.

10. Resonant antenna as claimed in claim 8, wherein the radiating electric conductor is connected to the wave emitter/receiver by means of an electromagnetic coupling zone.

11. Resonant antenna as claimed in claim 10, wherein the dimensions of the electromagnetic coupling zone partially determine the real impedance of the antenna.

12. Resonant antenna as claimed in claim 4, wherein the radiating electric conductor is composed of a first, a second and a third strands.

13. Resonant antenna as claimed. in claim 1, wherein the consecutive strands of the radiating electric conductor are oriented in two directions which are orthogonal with respect to one another.

14. Resonant antenna as claimed in claim 1, wherein the strands are each formed by a band of which the width is determined in such a manner as to adapt, at least partially, the real impedance of the antenna to the impedance of a wave emitter/receiver intended to be connected to the antenna.

15. Resonant antenna as claimed in claim 1, wherein the radiating electric conductor is composed of wire strands.

16. Resonant antenna as claimed in claim 1, wherein the radiating electric conductor has a first end connected to a wave emitter/receiver and a second free end.

17. Resonant antenna as claimed in claim 1, wherein the radiating electric conductor is associated with a dielectric material reducing the dimensions of the antenna.

18. Omnidirectional resonant antenna, comprising:

one single radiating electric conductor formed of at least three strands placed end to end, a length of each of the three strands and an orientation of each of the three strands with respect to one another determining a global radiation of the electric conductor, the three strands oriented in at least three different spatial directions and the lengths of the three strands sized to provide, in use, an omnidirectional global radiation of the electric conductor operating in a half-space with respect to a reference plane or in all of space, wherein, the omnidirectional global radiation results in the electromagnetic radiation emitted being substantially uniform irrespective of the direction of the reference plane.

19. Omnidirectional resonant antenna, comprising:

one single radiating electric conductor formed of at least three strands placed end to end, a length of each of the three strands and an orientation of each of the three strands with respect to one another determining a global radiation of the electric conductor, the three strands oriented in at least three different spatial directions and the lengths of the three strands sized to provide, in use, an omnidirectional global radiation of the electric conductor operating in a half-space or in all of space, wherein, the omnidirectional global radiation results in the electromagnetic radiation emitted being substantially uniform irrespective of the direction of the half-space or in all of the space.

* * * * *